US009267427B2

(12) United States Patent
Sun et al.

(10) Patent No.: US 9,267,427 B2
(45) Date of Patent: Feb. 23, 2016

(54) VARIABLE GEOMETRY TURBINE VANE

(71) Applicant: Ford Global Technologies, LLC, Dearborn, MI (US)

(72) Inventors: Harold Huimin Sun, West Bloomfield, MI (US); Liangjun Hu, Dearborn, MI (US); Ben Zhao, Beijing (CN); Dave R. Hanna, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 293 days.

(21) Appl. No.: 13/915,452

(22) Filed: Jun. 11, 2013

(65) Prior Publication Data

US 2014/0360160 A1 Dec. 11, 2014

(51) Int. Cl.

| | |
|---|---|
| ***F02D 23/00*** | (2006.01) |
| ***F01D 5/14*** | (2006.01) |
| ***F02B 37/22*** | (2006.01) |
| ***F01D 17/16*** | (2006.01) |
| *F02B 37/24* | (2006.01) |

(52) U.S. Cl.

CPC ..... *F02B 37/22* (2013.01); *F01D 17/165* (2013.01); *F02B 37/24* (2013.01); *F05D 2220/40* (2013.01)

(58) Field of Classification Search

CPC ..... F02B 37/24; F01D 17/167; F02D 13/04; F01L 13/06; F01L 2760/004; F05D 2220/40; F05D 2240/12; F05D 2240/122; Y02T 10/144

USPC ..... 60/602; 123/320, 323; 415/151, 159, 415/115, 161–162, 164–165, 191, 211.2; 416/228, 229 A, 236 R

See application file for complete search history.

(56) References Cited

U.S. PATENT DOCUMENTS

| | | | | |
|---|---|---|---|---|
| 1,864,803 | A * | 6/1932 | Clark | 416/236 R |
| 2,597,510 | A * | 5/1952 | McBride | 415/115 |
| 3,614,260 | A * | 10/1971 | Ellinger | 416/158 |
| 5,169,290 | A * | 12/1992 | Chou | 416/236 R |
| 6,378,305 | B1 * | 4/2002 | Sumser et al. | 60/602 |
| 6,546,728 | B2 * | 4/2003 | Schmidt et al. | 60/602 |
| 6,568,909 | B2 * | 5/2003 | Szucs et al. | 416/228 |
| 7,604,461 | B2 * | 10/2009 | Bonnet | 416/236 R |
| 8,047,801 | B2 | 11/2011 | Fang et al. | |
| 8,172,516 | B2 * | 5/2012 | Parker et al. | 415/151 |
| 8,414,253 | B2 * | 4/2013 | Severin et al. | 415/159 |
| 8,601,812 | B2 * | 12/2013 | Parker | 60/602 |
| 2011/0135449 | A1 | 6/2011 | Parker et al. | |
| 2011/0223030 | A1 | 9/2011 | Huck et al. | |
| 2012/0286066 | A1 | 11/2012 | Holroyd | |
| 2013/0042608 | A1 | 2/2013 | Sun et al. | |

FOREIGN PATENT DOCUMENTS

| | | | | |
|---|---|---|---|---|
| GB | 2032048 A * | 4/1980 | | F15D 1/12 |
| WO | WO 9721931 A1 * | 6/1997 | | F15D 1/12 |

* cited by examiner

*Primary Examiner* — Thai Ba Trieu

(74) *Attorney, Agent, or Firm* — Julia Voutyras; Alleman Hall McCoy Russell & Tuttle LLP

(57) ABSTRACT

Embodiments may provide variable geometry turbine, a nozzle vane for a variable geometry turbine, and a method. The variable geometry turbine that may include a turbine wheel and a plurality of adjustable vanes radially positioned around the turbine wheel. The turbine may also include a flow disrupting feature on one or more outside surfaces of one or more of the plurality of adjustable vanes.

23 Claims, 7 Drawing Sheets

VARIABLE GEOMETRY TURBINE VANE

FIELD

The present application relates to a variable geometry turbine vane, a turbocharger and a method wherein one or more flow modification features that may mitigate shock waves and/or other undesirable flow effects during engine braking.

BACKGROUND AND SUMMARY

Engines may use a turbocharger to improve engine torque and/or power output. A turbocharger may include a turbine disposed in line with the engine's exhaust stream, and coupled via a drive shaft to a compressor disposed in line with the engine's intake air passage. The exhaust-driven turbine may then supply energy, via the drive shaft, to the compressor to boost the intake air pressure. The desired amount of boost may vary over operation of the engine. One approach to controlling the boost pressure is to use a variable geometry turbine to vary the flow of exhaust gas through the turbine. The variable geometry turbine may include a variable turbine nozzle configured to control the angle at which exhaust gas strikes the turbine blades, and/or to control a cross-sectional area of channels upstream from the turbine blades through which the exhaust passes.

One type of variable geometry turbine includes a number of pivot-able nozzle vanes. Exhaust gas flowing through the turbine nozzle flows through channels formed between the nozzle vanes. Pivoting the vanes in one direction may increase the cross-sectional area of channels upstream of the turbine and may decrease the incident angle of gas flowing across the turbine blade(s). Pivoting the vanes in the other direction may decrease the cross-sectional area of channels upstream of the turbine and may increase the incident angle of gas flowing across the turbine blade.

Engine braking is a technique wherein the engine may be used to help slow a vehicle in order to, for example, reduce wear on a vehicle's brakes and/or to reduce the amount of heat that may otherwise be generated if only the vehicle brakes are used to slow, or stop the vehicle. During engine braking the exhaust gas stream is constricted thereby creating a backpressure in the exhaust passage. The piston(s) in the engine are thereby forced to work against the backpressure to expel the combusted gas from the cylinder(s). In a turbocharged engine with a variable geometry the nozzle vanes can be used to constrict the flow. However when the flow is restricted the gas that is allowed to pass is directed toward the turbine with greatly increased speed. This may cause shock waves. This may generate strong interaction and excitation on turbine blades downstream. This shock wave induced excitation, which may also be referred to as force response excitation, or fluid structure interaction, may be a source of high cycle fatigue concern of the turbine blades and a limiting factor of further increasing the exhaust braking power of turbocharged diesel engines.

The basic design of variable geometry turbines has been modified to yield various advantageous results. For example, U.S. Patent Publication 20130042608 attempts to provide a way to independently vary the cross-sectional area of the channels between nozzle vanes and the angle of incidence of gas flowing across the turbine blade. The disclosure provides an annular turbine nozzle having a central axis and a number of nozzle vanes. Each nozzle vanes include a stationary vane and a sliding vane. The sliding vane is positioned to slide in a direction substantially tangent to an inner circumference of the turbine nozzle. The vane modification accordingly attempts to substantially maintain a desired angle of incidence and a preferred cross-sectional area of the channels over a range of engine operating conditions.

The inventors herein have identified a number of shortcomings with this approach. For example, the disclosure fails to address the potential shock issues when the cross-sectional area of the channels is made small to constrict flow in an engine braking condition and the flow is consequently relatively very fast.

Embodiments in accordance with the present disclosure may provide a variable geometry turbine that may include a turbine wheel and a plurality of adjustable vanes radially positioned around the turbine wheel. The turbine may also include a flow disrupting feature on one or more outside surfaces of one or more of the plurality of adjustable vanes. In some example embodiments the flow disrupting feature may be a plurality of flow disrupting features that may each be adjacent to a respective trailing edge of the plurality of adjustable vanes. In this way the intensity of a possible shock wave may be reduced on the turbine blades. Also in this way possible excitation on the turbine blades may be reduced.

With various embodiments the adjustable vanes may be adjustable in a pivoting fashion, and/or they may be adjustable in another fashion. For example, each may include two or more portions that may move relative to one another. In some embodiments one or more nozzle vanes may each include a stationary portion and a sliding portion. In such embodiments one of the portions, for example a portion that may extend forward in a leading edge direction, may include one or more flow disrupting features in accordance with the present disclosure.

In some example embodiments the flow disrupting feature may be grooves or dimples. In some cases the grooves or dimples may be of different scales on an otherwise smooth nozzle vane surface. The nozzle vane surface may face the turbine blades. In this way the flow disrupting feature(s) may effectively disperse a sharp and strong shock wave into much weakened shock waves that may be spread over a finite area.

Some example embodiments may provide a nozzle vane for a variable geometry turbine for a turbocharger. The nozzle vane may include a leading edge and a trailing edge. The nozzle vane may also include an outside surface for directing a flow of exhaust gases toward a turbine of the turbocharger from the leading edge toward the trailing edge, and one or more flow disrupting features on the outside surface to disrupt the flow adjacent to the trailing edge.

Various other example embodiments may provide a method, including during engine braking, expanding exhaust gas through a variable geometry nozzle of a turbocharger; and disrupting flow via flow disrupting grooves on a surface of nozzle vanes upstream from exhaust vanes of the turbocharger.

Various embodiments may provide a solution that may be applied to a wide variety of variable geometry turbines with swing nozzle vanes. In this way it may be avoided that the turbine blades be made more thick and therefore thick enough to have the structure natural frequency to operational frequency ratio above, for example 7.0, as may heretofore have been proposed in order to withstand a strong shock wave induced excitation or force response excitation on the turbine blades.

Some embodiments may provide a change in the orientation of grooves on the nozzle surface which may manipulate the angle of interaction or excitation in the space domain of the shock wave on the turbine blade, and may thus regulate and weaken the excitation in the time domain on the specific location of the turbine blade. With the weakened shock wave excitation in accordance with the present disclosure, the turbine blade design may be optimized for better aerodynamic performance, in terms of efficiency and flow capacity, with structural natural frequency to operational frequency ratio as low as 5. This may reduce the inertia and weight, of the nozzle without high cycle fatigue concerns due to shock wave induced excitation on the blades.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
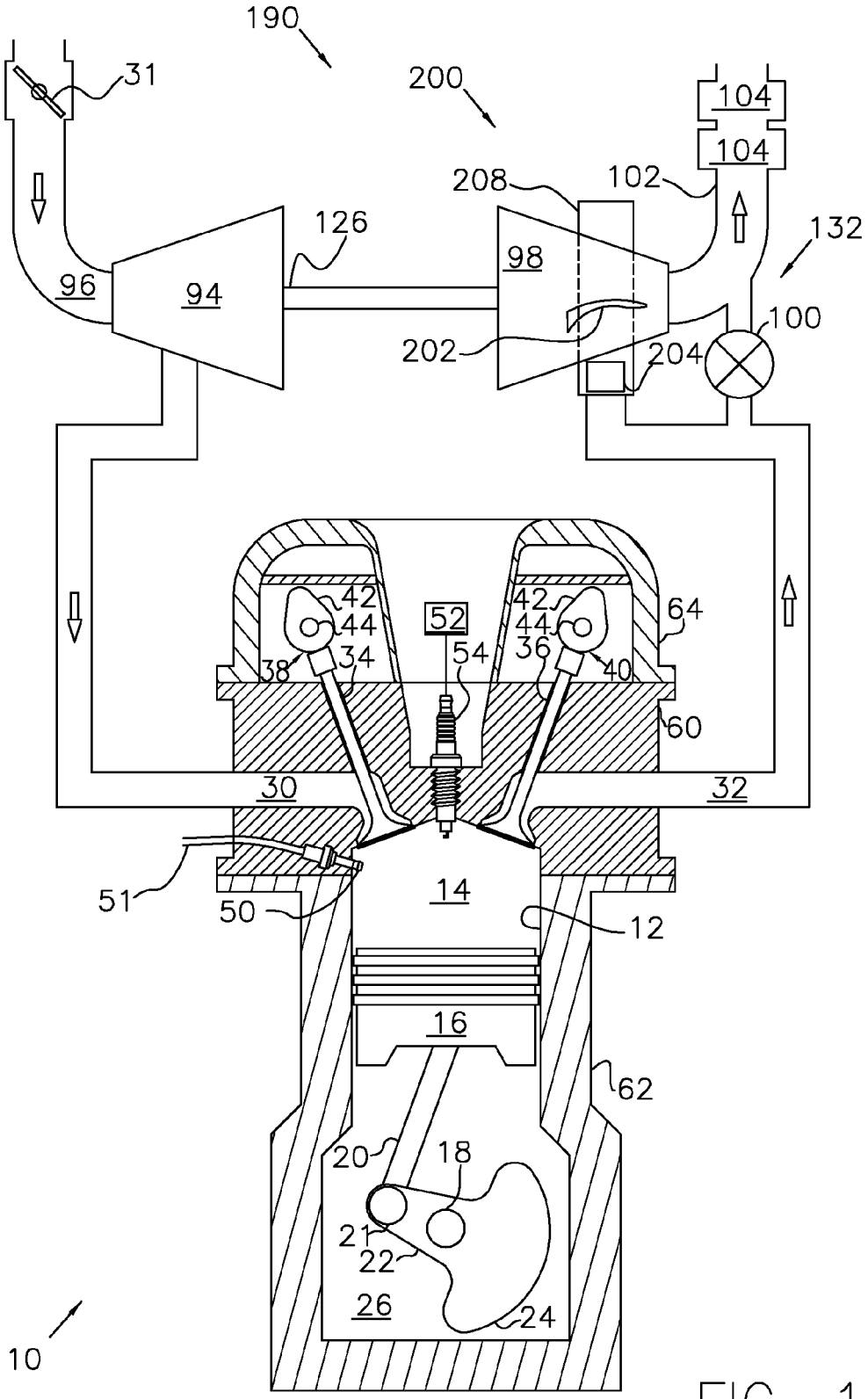
FIG. 1 is a schematic diagram of an example engine in accordance with the present disclosure.

FIG. 1 is a cross-sectional diagram with schematic portions, illustrating a cross-section of an engine 10 in accordance with the present disclosure. Various features of the engine 10 may be omitted, or illustrated in a simplified fashion for ease of understanding of the current description. For example, areas may be illustrated with continuous cross hatching that may otherwise indicate a solid body, however actual embodiments may include various engine components, and/or hollow, or empty, portions of the engine.

The cross-sectional view shown in FIG. 1 may be considered taken through one cylinder 12 of the engine 10. Various components of the engine 10 may be controlled at least partially by a control system that may include a controller (not shown), and/or by input from a vehicle operator via an input device such as an accelerator pedal (not shown). The cylinder 12 may include a combustion chamber 14. A piston 16 may be positioned within the cylinder 12 for reciprocating movement therein. The piston 16 may be coupled to a crankshaft 18 via a connecting rod 20, a crank pin 21, and a crank throw 22 shown here combined with a counterweight 24. Some examples may include a discrete crank throw 22 and counterweight 24. The reciprocating motion of the piston 16 may be translated into rotational motion of the crankshaft 18. The crankshaft 18, connecting rod 20, crank pin 21, crank throw 22, and counterweight 24, and possibly other elements not illustrated may be housed in a crankcase 26. The crankcase 26 may hold oil. Crankshaft 18 may be coupled to at least one drive wheel (not shown) of a vehicle via an intermediate transmission system. Further, a starter motor may be coupled to crankshaft 18 via a flywheel to enable a starting operation of engine 10. The drive wheel, or wheels, may be in rolling contact with a drive surface. The wheel(s) may include a braking system that when applied may slow or stop the wheels from rotation. In addition the action of the engine 10, in addition to providing a motive force to effect movement, may provide a braking, or retarding force to slow, or stop the wheel(s) from rotating.

Combustion chamber 14 may receive intake air from an intake passage 30, and may exhaust combustion gases via exhaust passage 32. Intake passage 30 and exhaust passage 32 may selectively communicate with combustion chamber 14 via respective intake valve 34 and exhaust valve 36. A throttle 31 may be included to control an amount of air that may pass through the intake passage 30. In some embodiments, combustion chamber 14 may include two or more intake valves and/or two or more exhaust valves.

In this example, intake valve 34 and exhaust valve 36 may be controlled by cam actuation via respective cam actuation systems 38 and 40. Cam actuation systems 38 and 40 may each include one or more cams 42 and may utilize one or more of cam profile switching (CPS), variable cam timing (VCT), variable valve timing (VVT) and/or variable valve lift (VVL) systems that may be operated by the controller to vary valve operation. The cams 42 may be configured to rotate on respective revolving camshafts 44. As depicted, the camshafts 44 may be in a double overhead camshaft (DOHC) configuration, although alternate configurations may also be possible. The position of intake valve 34 and exhaust valve 36 may be determined by position sensors (not shown). In alternative embodiments, intake valve 34 and/or exhaust valve 36 may be controlled by electric valve actuation. For example, cylinder 12 may include an intake valve controlled via electric valve actuation and an exhaust valve controlled via cam actuation including CPS and/or VCT systems.

In one embodiment, twin independent VCT may be used on each bank of a V-engine. For example, in one bank of the V, the cylinder may have an independently adjustable intake cam and exhaust cam, where the cam timing of each of the intake and exhaust cams may be independently adjusted relative to crankshaft timing.

Fuel injector 50 is shown coupled directly to combustion chamber 14 for injecting fuel directly therein in proportion to a pulse width of a signal that may be received from the controller. In this manner, fuel injector 50 may provide what is known as direct injection of fuel into combustion chamber 14. The fuel injector 50 may be mounted in the side of the combustion chamber 14 or in the top of the combustion chamber 14, for example. Fuel may be delivered via fuel line 51 to fuel injector 50 by a fuel system that may include a fuel tank, a fuel pump, and a fuel rail (not shown). In some embodiments, combustion chamber 14 may alternatively or additionally include a fuel injector arranged in intake passage 30 in a configuration that provides what is known as port injection of fuel into the intake port upstream of combustion chamber 14. The fuel line 51 may be a hose, or passage which may be coupled to a mating engine component, such as cylinder head 60.

Ignition system 52 may provide an ignition spark to combustion chamber 14 via spark plug 54 in response to a spark advance signal from the controller, under select operating modes. Though spark ignition components are shown, in some embodiments the combustion chamber 14 or one or more other combustion chambers of engine 10 may be operated in a compression ignition mode, with or without an ignition spark.

Cylinder head 60 may be coupled to a cylinder block 62. The cylinder head 60 may be configured to operatively house, and/or support, the intake valve(s) 34, the exhaust valve(s) 36, the associated valve actuation systems 38 and 40, and the like. Cylinder head 60 may also support the camshafts 44. A cam cover 64 may be coupled with and/or mounted on the cylinder head 60 and may house the associated valve actuation systems 38 and 40, and the like. Other components, such as spark plug 54 may also be housed and/or supported by the cylinder head 60. A cylinder block 62, or engine block, may be configured to house the piston 16. In one example, cylinder head 60 may correspond to a cylinder 12 located at a first end of the engine. While FIG. 1 shows only one cylinder 12 of a multi-cylinder engine 10, each cylinder 12 may similarly include its own set of intake/exhaust valves, fuel injector, spark plug, etc.

The engine 10 may include a turbocharger 190 having a turbo compressor 94 disposed on an induction air path 96 for compressing an induction fluid before the induction fluid is passed to the intake passage 30 of the engine 10. In some applications, an inter-cooler (not shown) may be included to cool the intake charge before it enters the engine. The turbo compressor 94 may be driven by an exhaust turbine 98 which may be driven by exhaust gasses leaving the exhaust manifold 32. In some cases, the throttle 31 may be downstream from the turbo compressor 94 instead of upstream as illustrated. The turbo compressor 94 may be coupled for rotation with the exhaust turbine 98 via a turbine shaft 126. The turbine shaft 126 may be supported for rotation by turbine bearings (not shown), and may be lubricated with a turbine bearing lubrication system. Although not illustrated, the engine 10 may include an exhaust gas recirculation EGR line and/or EGR system.

The flow of exhaust gasses through the exhaust turbine 98 may be regulated, or controlled by, for example, a wastegate 100 configured to divert exhaust gases away from the exhaust turbine 98 and to an exhaust line 102. Diverting the exhaust gases may help regulate the speed of the exhaust turbine 98 which in turn may regulate the rotating speed of the turbo compressor 94. The wastegate 100 may be configured as a valve. The wastegate 100 may be used to regulate, for example, a maximum boost pressure in the turbocharger system, which may help protect the engine and the turbocharger.

The exhaust line 102 may include one or more emission control devices 104, which may be mounted in a close-coupled position in the exhaust line 102. The one or more emission control devices 104 may include, for example, a three-way catalyst, lean NOx trap, diesel particulate filter, oxidation catalyst, etc.

Figure 2:
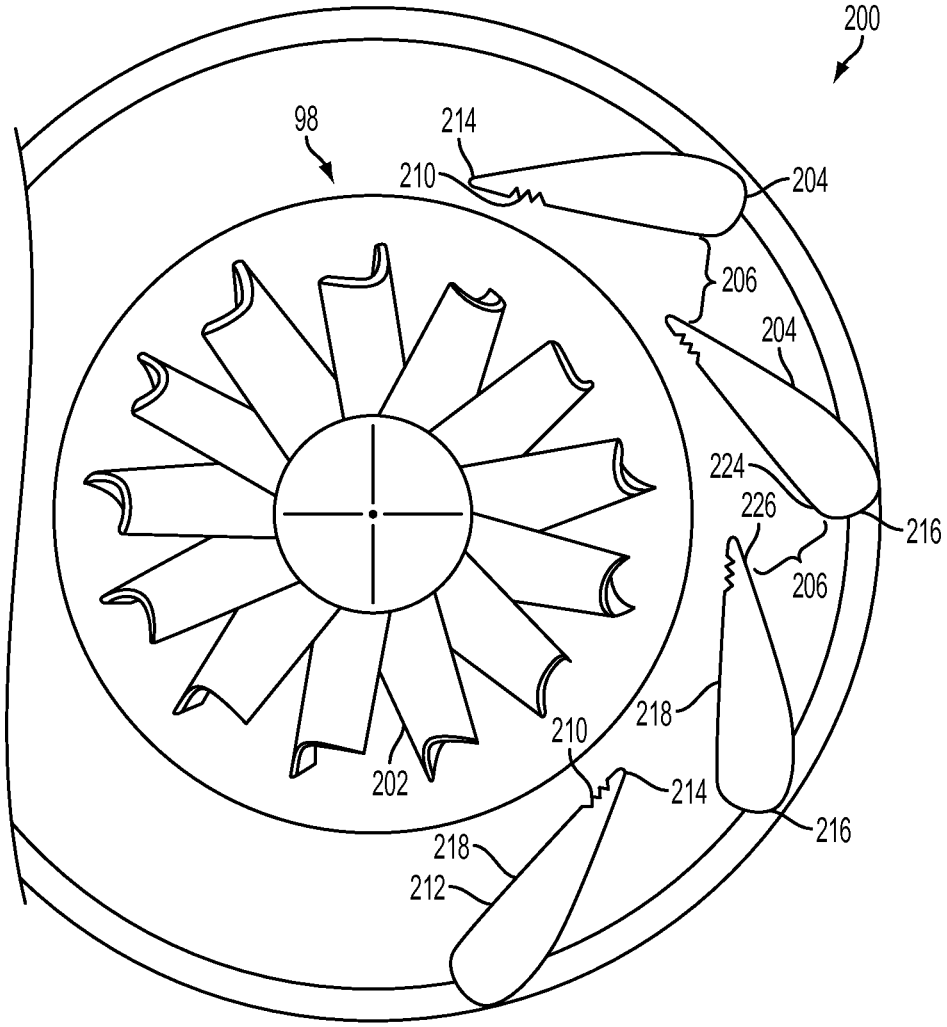
FIG. 2 is a side view of a portion of a variable geometry turbine in accordance with the present disclosure.
Figure 3:
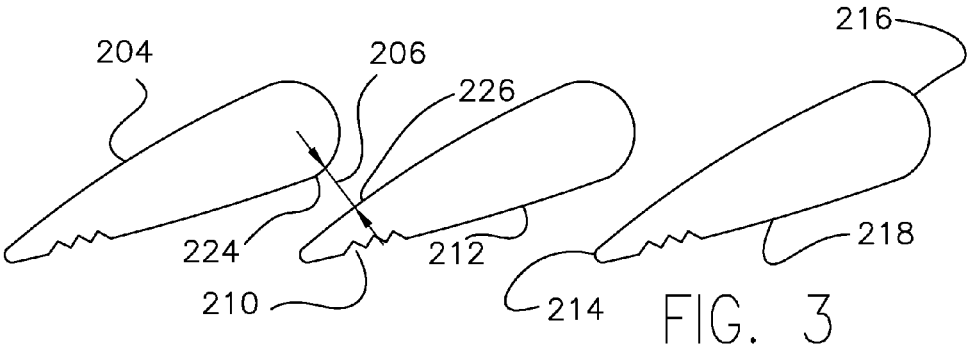
FIG. 3 is "radial" view of a number nozzle vanes schematically representing an example relative spacing thereof in accordance with the present disclosure.

FIG. 2 is a side view of a portion of a variable geometry turbine in accordance with the present disclosure. FIG. 3 is "radial" view of a number nozzle vanes 204 schematically representing an example relative spacing thereof. Referring now to FIGS. 1-3 the engine 10 may also include a variable geometry turbine 200 that may be configured to adjust a desired amount of boost provided by the compressor 94. The variable geometry turbine 200 may vary the flow of exhaust gas through the turbine 98 which may include controlling the angle at which exhaust gas strikes one or more turbine blades 202, and/or to control a cross-sectional area of channels 206 between nozzle vanes 204 upstream from the turbine blades 202 through which the exhaust passes. The vanes 204 may be configured to pivot in one direction to increases the cross-sectional area of channels 206 upstream of the turbine, which may also decreases an incident angle of gas flowing across the turbine blades 202. The vanes 204 may also be configured to pivot in the opposite direction to decreases the cross-sectional area of channels 206, which may increases the incident angle of gas flowing across the turbine blades. The nozzle vanes 204 may be housed in a housing 208.

The vanes 204 may also be configured to pivot to significantly constrict the exhaust flow. This may create a backpressure in the exhaust passage 32. The piston(s) 16 may then be forced to work against the backpressure to expel the combusted gas from the cylinder(s) 12 slowing the engine 10, and slowing the vehicle. This may be referred to as engine braking.

The embodiments illustrated may include a variable geometry turbine 200 that may include a turbine wheel 98, and a plurality of adjustable vanes 204 radially positioned around the turbine wheel 98. A flow disrupting feature 210 may be included on one or more outside surfaces 212 of one or more of the plurality of adjustable vanes 204. The flow disrupting feature 210 may be a plurality of flow disrupting features 210 each adjacent to a respective trailing edge 214 of the plurality of adjustable vanes 204. In this way, the flow disrupting features 210 may reduce or eliminate a shock wave that may otherwise occur when the exhaust gas passes through the constricted channel(s) 206.

With some embodiments the each flow disrupting feature 210 may occupy all or some portion of the surface 212 of one or more adjustable vanes 204. For example in some cases each flow disrupting feature 210 may occupy approximately 10% to 40% of a surface area 212 of one side of each of the plurality of adjustable vanes 204.

Embodiments may provide a variable geometry turbine 200 wherein the plurality of adjustable vanes 204 may be adjustable to constrict flow of an exhaust gas in a corresponding plurality of constricted paths 206. The plurality of constricted paths 206 may be disposed between a leading edge 216 of one vane 204 and trailing edge 210 of an adjacent vane 204. The flow disrupting feature 210 may be a corresponding plurality of flow disrupting features 210 on each vane on a side opposite 218 to respective plurality of constricted paths 206.

Figure 5:
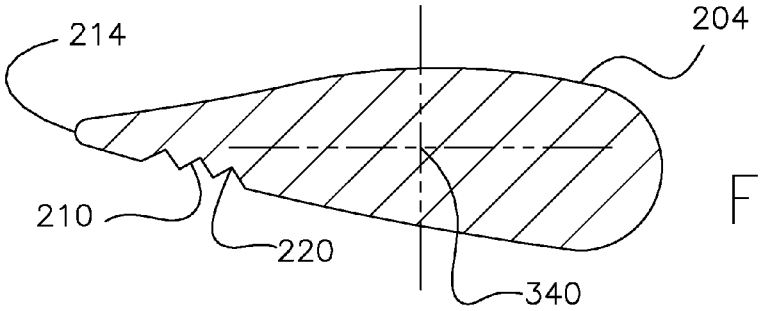
FIG. 5 is a sectional view taken at the line 5-5 in FIG. 4.
Figure 4:
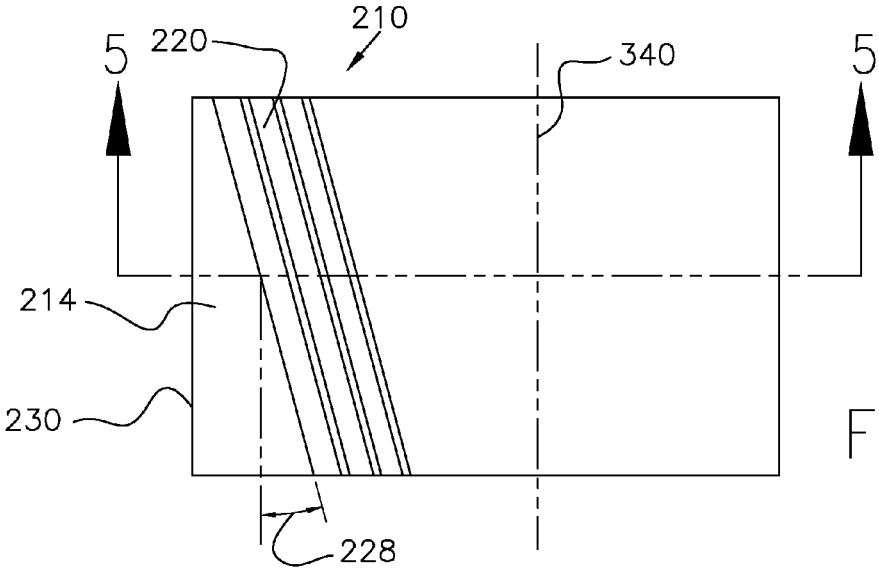
FIG. 4 is an example bottom view of one example vane of a variable geometry turbine which may be used with the engine illustrated in FIG. 1.

FIG. 4 is an example bottom view of one example vane 204, and FIG. 5 is a sectional view taken at the line 5-5 in FIG. 4. The example illustrates a case wherein the flow disrupting feature 210 may include includes a groove 220. In some cases the flow disrupting feature 210 may includes two or more parallel grooves 220.

Figure 6:
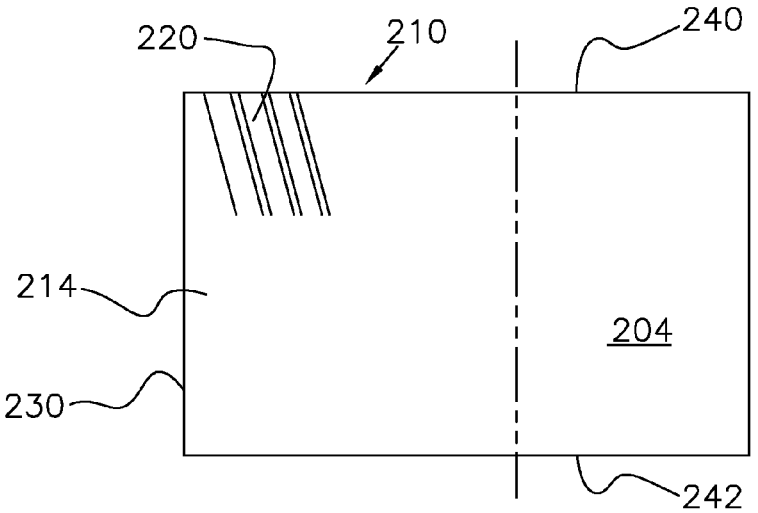
FIG. 6 is an example bottom view of an example vane of a variable geometry turbine including flow disrupting features located substantially adjacent a first side of the vane.
Figure 7:
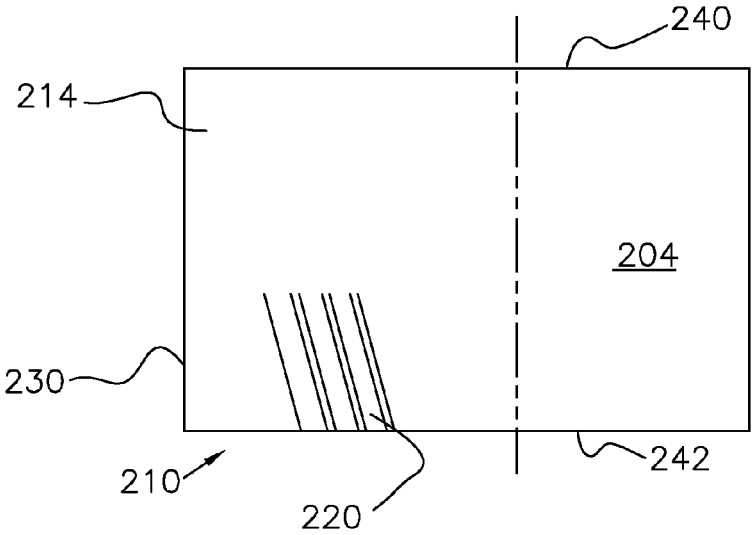
FIG. 7 is an example bottom view of another example vane of a variable geometry turbine including flow disrupting features located substantially adjacent a second side of the vane.

FIG. 6 is an example bottom view of another example vane 204 of a variable geometry turbine wherein a flow disrupting feature 210 may be located substantially adjacent to a first side 240 of a bottom of each of the one or more of the plurality of adjustable vanes. The first side may be a hub side of the vane. FIG. 7 is an example bottom view of another example vane of a variable geometry turbine wherein a flow disrupting feature 210 may be located substantially adjacent to a second side 242 of a bottom of each of the one or more of the plurality of adjustable vanes. In the examples shown the flow disrupting features 210 are shown as grooves 220. In other cases the flow disrupting features 210 may be shaped differently.

Figure 8:
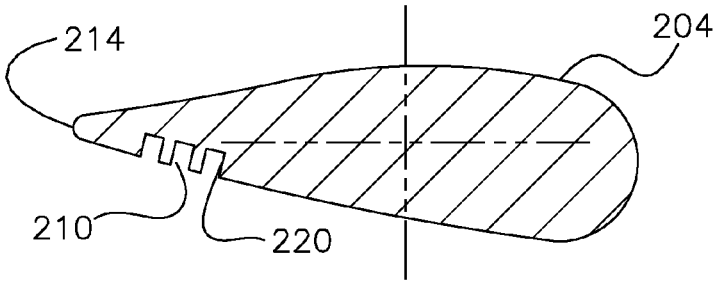
FIG. 8 is a sectional view of another vane in accordance with the present disclosure.

FIG. 8 is a sectional view of another vane 204 in accordance with the present disclosure wherein the flow disrupting features 210 may include two or more parallel grooves 220 wherein each may have a substantially rectangular cross section having a substantially flat bottom. This example may be compared with FIG. 5 wherein two or more parallel grooves 220 may form an angled or straight valley type profile.

Figure 10:
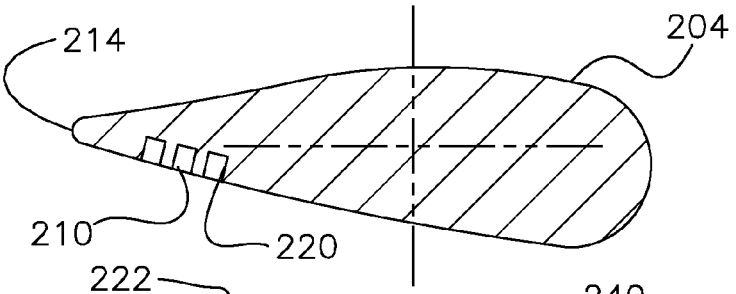
FIG. 10 is a sectional view taken at the line 10-10 in FIG. 9.
Figure 9:
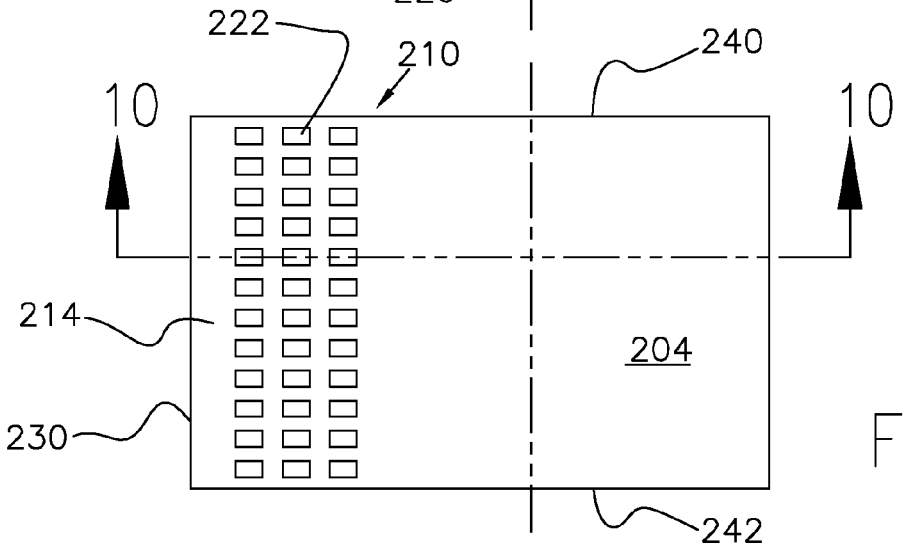
FIG. 9 is an example bottom view of another example vane including rectilinear flow disrupting features.

FIG. 9 is an example bottom view of another example vane 204 including rectilinear flow disrupting features, and FIG. 10 is a sectional view taken at the line 10-10 in FIG. 9. In some cases various fillet radii may be used. The example illustrated shows an area of similarly sized rectangular dimples 222 or holes from substantially the first side to the second side of the vane. In other examples the features may be arranged in other pattern, such as an offset pattern, or random, and the like. The features may all, or mostly be, located adjacent to the first side, or alternatively the second side. The features may be arranged parallel and perpendicular to the edges of the vane, or may be arranged at an angle.

Figure 11:
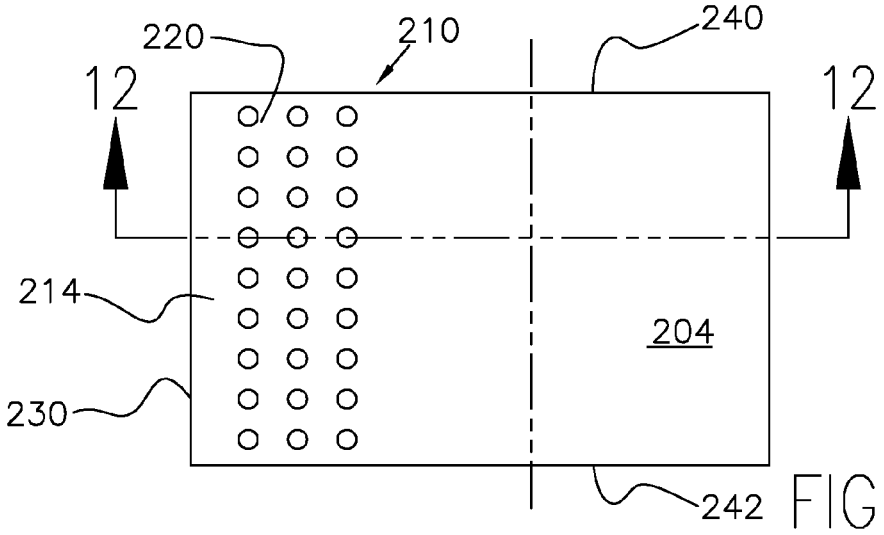
FIG. 11 is an example bottom view of another example vane including curvilinear flow disrupting features.
Figure 12:
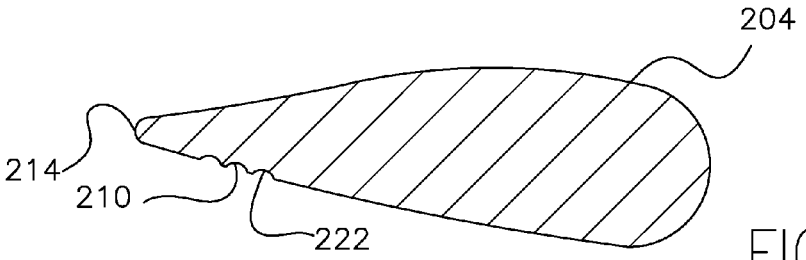
FIG. 12 is a sectional view taken at the line 12-12 in FIG. 9.

FIG. 11 is an example bottom view, and FIG. 12 is a sectional view taken at the line 12-12 in FIG. 11 Illustrating another example vane including curvilinear flow disrupting features. The example illustrates a case wherein the flow disrupting feature 210 may include a dimple 222. The flow disrupting feature 210 may include two or more dimples 222. The flow disrupting features 210 may include a plurality of substantially round dimples.

Various embodiments may provide a nozzle vane 204 for a variable geometry turbine 200 for a turbocharger 190. The nozzle vane 204 may include a leading edge 216, and a trailing edge 214. The nozzle vane 204 may have an outside surface 212 for directing a flow of exhaust gases toward a turbine 98 of the turbocharger 190 from the leading edge 216 toward the trailing edge 218. The nozzle vane 204 may also include one or more flow disrupting features 210 on the outside surface 212 to disrupt the flow adjacent to the trailing edge 214.

In some cases, the one or more flow disrupting features 210 may be one or more grooves 220 formed near the trailing edge 214. In other cases, the one or more flow disrupting features 210 may be one or more dimples 222 formed near the trailing edge 214. In still other cases, the flow disrupting features 210 may include a combination of grooves and dimples, or may include other shapes including, for example, holes, or bumps, and the like, and/or various combinations of various of features of various shapes. In various cases the flow disrupting features 210 may occupy various percentages of the outside surface area. For example the flow disrupting features 210 may occupy between 10% and 30% of one side of the outside surface 212.

The nozzle vane 204 and a plurality of similarly configured other nozzle vanes 204 may be arranged in a ring, and may be configured to pivot from a relatively non-constricting configuration to a flow constricting configuration wherein adjacent nozzle vanes 204 in the ring of nozzle vanes 204 may constrict the flow between a bottom, or radially inside, surface 224 of a leading edge 216 of one nozzle vane 204 and a top, or radially outside, surface 226 of a trailing edge 214 of an adjacent nozzle vane 204. The one or more flow disrupting features 210 may be on the bottom surface 224 near the trailing edge 214 of each nozzle vane 204.

The one or more flow disrupting features 210 may be parallel grooves 220 formed into the bottom surface 212 near the trailing edge 214. In some cases, the parallel grooves 220 may form an angle 228 with a terminal edge 230 of the trailing edge 214. In other cases, the parallel grooves may be substantially parallel with the terminal edge 230 of the trailing edge 214.

Figure 13:
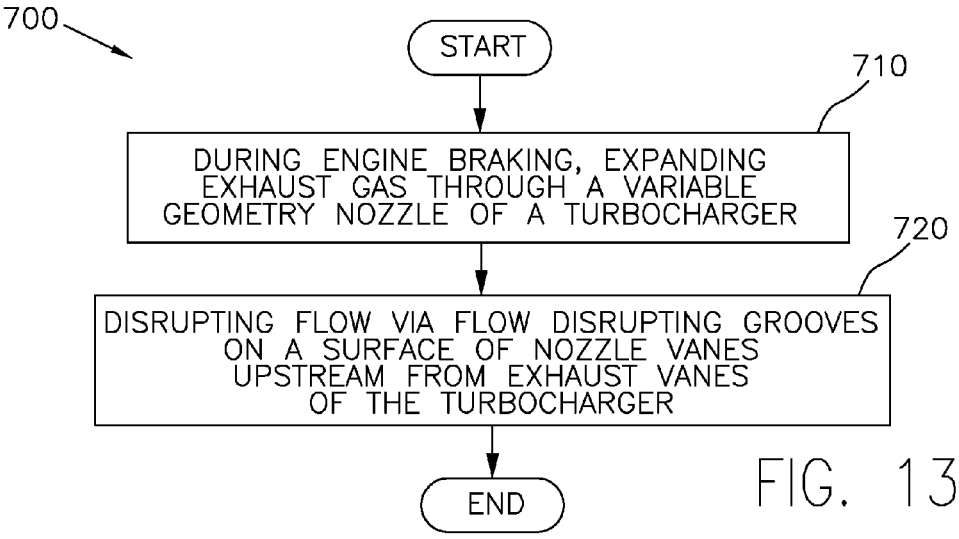
FIG. 13 is a flow diagram illustrating an example method in accordance with the present disclosure.

FIG. 13 is a flow diagram illustrating an example method 700 in accordance with the present disclosure. The method 700 may include, at 710, during engine braking, expanding exhaust gas through a variable geometry nozzle of a turbocharger. The method 700 may also include, at 720, disrupting flow via flow disrupting grooves on a surface of nozzle vanes upstream from exhaust vanes of the turbocharger.

Figure 14:
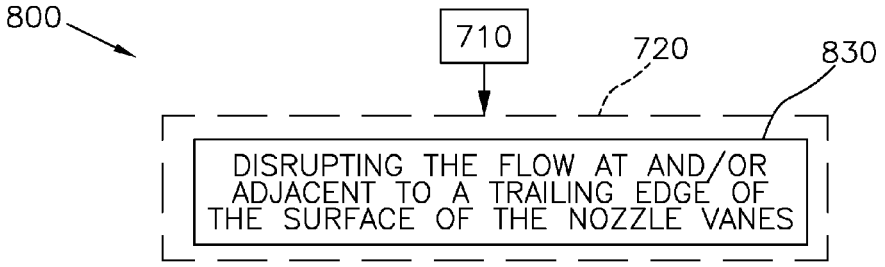
FIG. 14 is a flow diagram illustrating an example modification of the method illustrated in FIG. 13.

FIG. 14 is a flow diagram illustrating an example modification of the method 700 illustrated in FIG. 13. The modified method 800 may modify the disrupting the flow (720) by, at 830, disrupting the flow at and/or adjacent to a trailing edge of the surface of the nozzle vanes.

Figure 15:
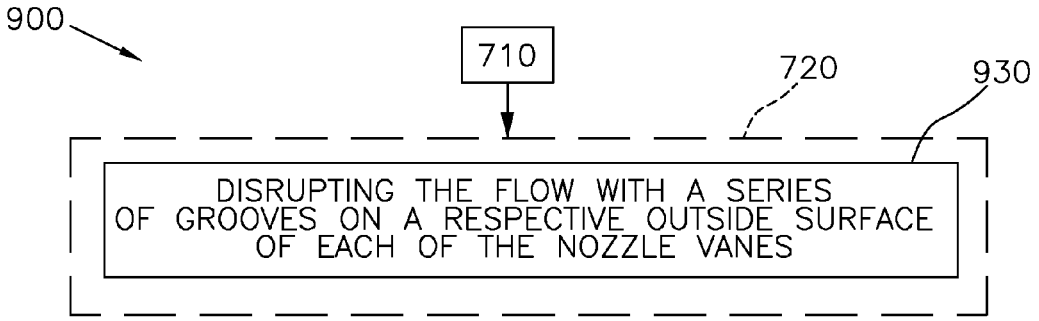
FIG. 15 is a flow diagram illustrating another example modification of the method illustrated in FIG. 13.

FIG. 15 is a flow diagram illustrating another example modification of the method 700 illustrated in FIG. 13. The modified method 900 may modify the disrupting the flow (720) by, at 930, disrupting the flow with a series of grooves on a respective outside surface of each of the nozzle vanes.

Figure 16:
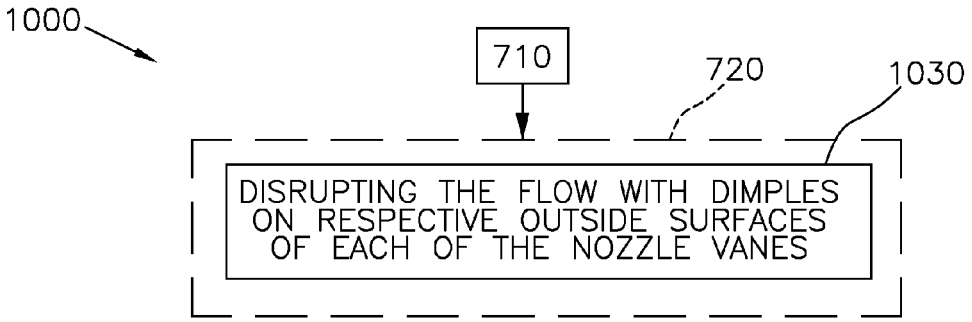
FIG. 16 is a flow diagram illustrating another example modification of the method illustrated in FIG. 13.

FIG. 16 is a flow diagram illustrating yet another an example modification of the method 700 illustrated in FIG. 13. The modified method 1000 may modify the disrupting the flow (720) by, at 1030, disrupting the flow with dimples on respective outside surfaces of each of the nozzle vanes.

Figure 17:
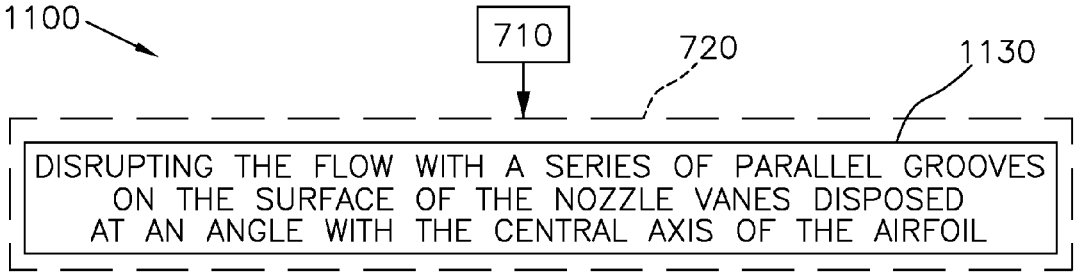
FIG. 17 is a flow diagram illustrating yet another example modification of the method illustrated in FIG. 13.

FIG. 17 is a flow diagram illustrating yet another an example modification of the method 700 illustrated in FIG. 13. In this example case the nozzle vanes may have an airfoil profile with a central axis 340 substantially normal to a cross section of the airfoil, as illustrated in FIGS. 3-4. Also in this case the modified method 1100 may modify the disrupting the flow (720) by, at 1130, disrupting the flow with a series of parallel grooves on the surface of the nozzle vanes disposed at an angle with the central axis 340 of the airfoil.

It should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. A variable geometry turbine comprising:

a turbine wheel;

a plurality of adjustable vanes radially positioned around the turbine wheel; and a flow disrupting feature on one or more outside surfaces of one or more of the plurality of adjustable vanes, wherein the one or more outside surfaces faces turbine blades.

2. The variable geometry turbine of claim 1, wherein the flow disrupting feature is a plurality of flow disrupting features each adjacent to a respective trailing edge of the plurality of adjustable vanes, and wherein the adjustable vanes are positioned upstream of the turbine blades.

3. The variable geometry turbine of claim 2, wherein each flow disrupting feature occupies approximately 10% to 40% of a surface area of one side of each of the plurality of adjustable vanes.

4. The variable geometry turbine of claim 1, wherein the flow disrupting feature includes a groove, the groove forming an angle with a terminal edge of a trailing edge of the plurality of adjustable vanes.

5. The variable geometry turbine of claim 1, wherein the flow disrupting feature includes two or more parallel grooves each having a substantially rectangular cross section.

6. The variable geometry turbine of claim 1, wherein the flow disrupting feature includes a dimple.

7. The variable geometry turbine of claim 1, wherein the flow disrupting feature includes a plurality of substantially round dimples.

8. The variable geometry turbine of claim 1, wherein the flow disrupting feature includes a plurality of substantially rectangular dimples.

9. The variable geometry turbine of claim 1, wherein the flow disrupting feature is adjacent to a first side of a bottom of each of the one or more of the plurality of adjustable vanes.

10. The variable geometry turbine of claim 1, wherein the flow disrupting feature is adjacent to a second side of a bottom of each of the one or more of the plurality of adjustable vanes.

11. The variable geometry turbine of claim 1, wherein the plurality of adjustable vanes are adjustable to constrict flow of an exhaust gas in a corresponding plurality of constricted paths disposed between a leading edge of one vane and a trailing edge of an adjacent vane, and wherein the flow disrupting feature is a corresponding plurality of flow disrupting features on each vane on a side opposite to respective plurality of constricted paths.

12. A nozzle vane for a variable geometry turbine for a turbocharger comprising:

a leading edge;

a trailing edge;

an outside surface for directing a flow of exhaust gases toward a turbine of the turbocharger from the leading edge toward the trailing edge;

one or more flow disrupting features on the outside surface to disrupt the flow adjacent to the trailing edge; and wherein the outside surface faces turbine blades of the turbocharger.

13. The nozzle vane of claim 12, wherein the one or more flow disrupting features are one or more grooves formed near the trailing edge.

14. The nozzle vane of claim 12, wherein the one or more flow disrupting features are one or more dimples formed near the trailing edge.

15. The nozzle vane of claim 12, wherein the one or more flow disrupting features occupy between 10% and 30% of one side of the outside surface.

16. The nozzle vane of claim 12, wherein the nozzle vane and a plurality of similarly configured other nozzle vanes are arranged in a ring, and configured to pivot from a relatively non-constricting configuration to a flow constricting configuration wherein adjacent nozzle vanes in the ring of nozzle vanes constrict the flow between a bottom surface of a leading edge of one nozzle vane and a top surface of a trailing edge of an adjacent nozzle vane, and wherein the one or more flow disrupting features are on a bottom surface near the trailing edge of each nozzle vane.

17. The nozzle vane of claim 16, wherein parallel grooves form an angle with a terminal edge of the trailing edge.

18. The nozzle vane of claim 16, wherein parallel grooves are substantially parallel with a terminal edge of the trailing edge.

19. A method of controlling exhaust gas flowing through a turbine of a turbocharger, comprising:

during engine braking, expanding exhaust gas through a variable geometry nozzle of the turbocharger; and disrupting flow via flow disrupting grooves on a surface of nozzle vanes upstream from exhaust vanes of the turbocharger, wherein the surface of the nozzle vanes faces turbine blades.

20. The method of claim 19, wherein the disrupting flow includes disrupting the flow with flow disrupting grooves adjacent to a trailing edge of the surface of the nozzle vanes.

21. The method of claim 19, wherein the disrupting flow includes disrupting the flow with a series of grooves on a respective outside surface of each of the nozzle vanes.

22. The method of claim 19, wherein the disrupting flow includes disrupting the flow with dimples on respective outside surfaces of each of the nozzle vanes.

23. The method of claim 19, wherein the nozzle vanes have an airfoil profile with a central axis substantially normal to a cross section of the airfoil, and wherein the disrupting the flow includes disrupting the flow with a series of parallel grooves on the surface of the nozzle vanes disposed at an angle with the central axis of the airfoil.

* * * * *